United States Patent [19]

Srinivasan et al.

[11] Patent Number: 4,578,249

[45] Date of Patent: Mar. 25, 1986

[54] PROCESS FOR RECOVERY OF URANIUM FROM WET PROCESS $H_3PO_4$

[75] Inventors: Viswanathan Srinivasan; Matthew H. Hulbert, both of Terre Haute, Ind.

[73] Assignee: International Minerals & Chemical Corp., Terre Haute, Ind.

[21] Appl. No.: 529,175

[22] Filed: Sep. 2, 1983

[51] Int. Cl.[4] ..... C01G 43/00; C25B 1/00

[52] U.S. Cl. ..... 423/10; 204/1.5

[58] Field of Search ..... 204/1.5; 423/10

[56] References Cited

U.S. PATENT DOCUMENTS

| | | | |
|---|---|---|---|
| 2,733,200 | 1/1956 | Kunin | 204/90 |
| 2,741,589 | 4/1956 | Kunin | 204/90 |
| 2,781,303 | 2/1957 | Boyer et al. | 204/1.5 |
| 3,711,591 | 1/1973 | Hurst et al. | 423/10 |
| 3,737,513 | 6/1973 | Wiewiorowski et al. | 423/8 |
| 3,753,181 | 8/1973 | Cochran | 204/103 |
| 3,927,186 | 12/1975 | Vinton et al. | 423/447 |
| 3,996,064 | 12/1976 | Thaller | 320/2 |
| 4,222,826 | 9/1980 | Riggs et al. | 204/1.5 |
| 4,225,396 | 9/1980 | Graham et al. | 204/1.5 |
| 4,302,427 | 11/1981 | Berry et al. | 423/10 |
| 4,341,602 | 7/1982 | Nenner et al. | 204/1.5 |
| 4,371,505 | 2/1983 | Pautrot | 204/1.5 |
| 4,382,116 | 5/1983 | Gahn et al. | 429/34 |

OTHER PUBLICATIONS

J. Wang, Electrochimica Acta, vol. 26, pp. 1721–1726, 1981.

*Primary Examiner*—Edward A. Miller

*Attorney, Agent, or Firm*—Robert H. Dewey

[57] ABSTRACT

A process for stripping hexavalent uranium from an organic solution using phosphoric acid containing ferrous ion wherein the ferrous ion is provided by electrolytic reduction of ferric ion with minimal production of hydrogen.

7 Claims, No Drawings

PROCESS FOR RECOVERY OF URANIUM FROM WET PROCESS $H_3PO_4$

This invention relates to the recovery of uranium from wet process phosphoric acid. In a particular aspect, this invention relates to an improvement in the process for recovery of uranium from wet process phosphoric acid.

Phosphate rock deposits often contain small amounts of uranium. For example, the phosphate rock mined in central Florida for fertilizer use contains about 140–180 ppm by weight of uranium. When the rock is digested with sulfuric acid to produce phosphoric acid (known as wet process phosphoric acid) the uranium is dissolved and passes into the acid phase.

It is well known to recover uranium values from phosphoric acid. An early process was disclosed by R. Kunin, U.S. Pat. Nos. 2,733,200 and 2,741,589 and an improved process, which has proven very successful, was taught by F. J. Hurst and D. J. Crouse in U.S. Pat. No. 3,711,591. W. W. Berry and A. V. Henrickson, U.S. Pat. No. 4,302,427 provided an improved process. These patents are incorporated herein by reference thereto.

Much of the uranium separation process disclosed by Hurst et al utilized recycle steps which need not be described here. Stated briefly, the process involves countercurrent extraction (the primary extraction) of green acid with a mixture of kerosene, di(2-ethylhexyl)-phosphoric acid and trioctylphosphine oxide (hereinafter designated the kerosene mixture) which removes substantially all of the uranium. Green acid (named for its color) is partially purified wet process acid after removal of insolubles and dark colored organic bodies. It contains metallic impurities (among others) such as iron which may be present in an amount of 10–12 g/l. Prior to the primary extraction, the green acid is treated with an oxidizing agent, usually hydrogen peroxide, to convert any $U^{+4}$ to $U^{+6}$ and any $Fe^{+2}$ to $Fe^{+3}$. The primary extraction is now carried out and the $U^{+6}$ passes into the kerosene phase.

The kerosene mixture containing the uranium is now subjected to another extraction step (usually designated as the stripping step) to remove and concentrate the uranium which must be reduced to $U^{+4}$ to render it insoluble in the kerosene mixture and soluble in the stripping agent. The extractant, hereinafter referred to as the stripping agent, is phosphoric acid containing sufficient ferrous ion to reduce $U^{+6}$ to $U^{+4}$. Green acid is conveniently used for this step because it is only necessary to reduce the ferric iron present in the acid to the ferrous state. This is usually effected by addition of powdered metallic iron in stoichiometrically sufficient amounts.

As the uranium ion is reduced, it passes into the stripping agent and the ferrous ion is oxidized to ferric. The stripping agent and kerosene form a two-phase mixture, which is sent to a settling vessel where the phases separate and are drawn off. The phosphoric acid phase containing the uranium is treated to an oxidation step to convert the $U^{+4}$ to $U^{+6}$ and once again the uranium is extracted with the kerosene mixture (the secondary extraction). The resulting kerosene solution containing the uranium is then treated to recover the uranium as the oxide (or yellow cake) by any suitable method, e.g. by the method of Hurst et al.

This process has been commercially quite successful but the iron present in the stripping agent forms a precipitate which settles out in the settling vessel during the phase separation step. Consequently, the vessel must be cleaned frequently, but this step results in lower production capacity, losses of phosphoric acid and loss of some uranium. This part of the process is disadvantageous and, accordingly, there is a need to minimize the amount of iron present in the stripping agent, and especially to eliminate the addition of iron.

Some workers have proposed electrolytic reduction of iron. Boyer et al, U.S. Pat. No. 2,781,303, disclosed reduction of hexavalent uranium and ferric iron using a mercury cathode. Cochran, U.S. Pat. No. 3,573,181, disclosed reduction of ferric iron to ferrous using a carbon or impervious graphite cathode. Hurst et al, U.S. Pat. No. 3,711,591, taught that ferric ion may be reduced electrolytically but did not disclose a method for doing so, and Wiewiorowski, U.S. Pat. No. 3,737,513, disclosed a method for continuous reduction of the stripping solution using a conventional steel cathode.

However, none of these electrolytic processes has proved commercially successful, probably because an excessive amount of electric current was consumed in hydrogen production so there is a need for an improved electrolytic process.

SUMMARY OF THE INVENTION

It is an object of this invention to provide an improved process for the recovery of uranium from wet process phosphoric acid.

It is another object of this invention to provide an improved process for recovery of uranium from wet process phosphoric acid whereby the addition of metallic iron is eliminated.

Other objects of this invention will be apparent to those skilled in the art from the disclosure herein.

The objects of this invention are provided by an improvement in the process for stripping hexavalent uranium from an organic solution containing it by contacting it with a stripping agent containing ferrous ion as a reducing agent whereby the uranium is reduced to the tetravalent state and passes into the stripping agent. Subsequently, the tetravalent uranium is again oxidized to the hexavalent state and is extracted by an organic solution from which it is subsequently recovered.

The improvement of this invention is to effect reduction of $Fe^{+3}$ to $Fe^{+2}$ in an electrolytic cell. The stripping agent containing ferric ions is passed through the cathode chamber of the cell where it contacts the cathode. The cathode is a high surface electrode having a high overpotential for hydrogen evolution. A current density of 0.5–30 $A/dm^2$ is applied to the cathode to effect reduction of $Fe^{+3}$ to $Fe^{+2}$ but without significant production of hydrogen.

DETAILED DISCUSSION

It is the discovery of this invention that ferric ion can be reduced to ferrous ion without undue reduction of hydrogen ion to hydrogen at high current densities. Such reduction can be effected by using as the cathode a high surface area electrode which can be provided by reticulated vitreous carbon (RVC), carbon felt, carbon mat, or porous flow-through carbon. RVC is preferred. Surprisingly, it makes possible current densities far greater than other materials. In fact, a current density of up to 30 $A/dm^2$ is economically feasible at a cathode working potential between approximately 0 mV and −1400 mV versus a saturated calomel electrode. Lead oxide coated on lead is a suitable anode.

The roughened graphite electrode is a smooth electrode that has been roughened by passing an anodic current at 1.5 amperes/$dm^2$ and 5 volts for 10 minutes. Such electrodes are known in the art.

RVC is a known composition disclosed in U.S. Pat. No. 3,927,186 issued to Chemotronics International, Inc., Ann Arbor, Mich., and is manufactured by ERG, Inc., Oakland, Calif. It has a high surface area to volume ratio, having a 97% void volume. It is used as an electrode in electro-analytical procedures but also has uses outside the electrochemical area. It is an open pore material with a honeycomb structure which is composed almost entirely of vitreous carbon. It is available in several porosity grades from 10–100 pores per inch (ppi), with a surface area up to 66 $cm^2/cm^3$. J. Wang has reviewed this material in Electrochimica Acta, Volume 26, pages 1721–26 (1981). Any porosity can be used in the practice of this invention, but 100 ppi is preferred. Several special forms of RVC are available but generally they offer no advantages over the standard.

Carbon felt, carbon mat and porous flow-through carbon are materials known in the art. They can be readily fabricated into electrodes by one of ordinary skill.

According to the process of this invention, an electrolytic cell is provided using an anode and a cathode separated by a suitable membrane, many of which are known, such as Nafion 324 cationic exchange membrane, manufactured by E. I. DuPont de Nemour Company, Wilmington, Del. The walls of the cell are constructed of a non-conducting material. The electrodes can be of the same material or they can be different. Thus, the electrolytic cell consists of two chambers, one for anolyte and one for catholyte.

In the previous process, a stripping agent comprising phosphoric acid at 30–36% $P_2O_5$ and ferric ion at 10–20 g/l is treated with metallic iron and the resulting solution is used to extract the organic solution containing uranium. In the present process the stripping agent (the catholyte) at a temperature of 25°–50° C. is passed through the catholyte chamber of the cell where the ferric ion is reduced at a current density of 0.5 to 30 A/$dm^2$, preferably about 5 to 20. The residence time of the catholyte in the chamber is sufficient to effect reduction of $Fe^{+3}$, e.g. for from about 8 to 15 minutes. The current is supplied from a power source at a voltage of about 5–6.

The phosphoric acid used to prepare the stripping agent can be fresh green acid or it can be recycled raffinate from the secondary extraction step, since both have low uranium contents. Preferably, however, the acid strength is increased to 30–32% $P_2O_5$ by the addition of 40% phosphoric acid (expressed as $P_2O_5$).

After the electrolytic reduction step, the stripping agent is used to strip the kerosene solution of uranium in accordance with the previous process, e.g. the method of Hurst et al.

The invention will be better understood with reference to the following examples. It is understood that the examples are intended only to illustrate the invention and it is not intended that the invention be limited thereby.

EXAMPLE 1

A commercially-available, filter-press type, electrochemical cell was chosen for this experiment. It was obtained from Swedish National Development Company, Akersberga, Sweden. The cell consisted of a cathode, an anode and a Nafion 324 cation exchange membrane obtained from E. I. DuPont de Nemour Company, Wilmington, Del., separating the anode and cathode compartments. Electric current was supplied by a 50 AMP, 18 volt direct current power supply obtained from Rapid Electric Company, Brookfield, Conn. An anolyte feed reservoir was connected through a pump to the product collection vessel. Similarly, a catholyte feed reservoir was connected through a pump to the input of the catholyte chamber and the outlet was connected to a product collection vessel. Each chamber of the cell was connected to a gas collection vessel for collection of hydrogen from the cathode and oxygen from the anode.

The anode was lead oxide coated on metallic lead and the cathode was a sheet of reticulated vitreous carbon of 10×10×0.7 cm force-fitted into a graphite frame. One surface of the RVC sheet was grooved in a diamond pattern of about 15 grooves each way. The grooves were about 2 mm deep and about 1 mm wide. The purpose of the grooves was to promote electrolyte flow.

Green wet process phosphoric acid was obtained from a production plant. It had the following analysis:

| | | | |
|---|---|---|---|
| $P_2O_5$ | 27.5% wt | $SiO_2$ | 0.9% |
| $Fe_2O_3$ | 1.3 | MgO | 0.6 |
| $Al_2O_3$ | 0.9 | CaO | 0.2 |
| $SO_3$ | 1.7 | F | 2.1 |
| | | Water q.s. 100% | |

The two feed reservoirs were filled with the acid and flow through the cell was commenced. A current of 10 amperes per square decimeter at a compliance voltage of 3.8 was applied to the cell. The temperature was maintained at 45° C. $Fe^{+3}$ was reduced to $Fe^{+2}$ in 75% conversion at a current efficiency of 97%. The amount of hydrogen produced was negligible and the amount of oxygen produced was estimated to be 0.027 moles per liter of feed acid. The phosphoric acid containing ferrous ion was used to strip a kerosene mixture containing hexavalent uranium.

EXAMPLE 2

The experiment of Example 1 was repeated in all essential details except that a current of 20 amperes per square decimeter and a compliance voltage of 6 volts was applied. The conversion of ferric to ferrous ion was 90% at a current efficiency of 60%.

EXAMPLE 3

The experiment of Example 1 was repeated in all essential details except that a roughened graphite electrode was substituted for the RVC electrode and a current of 1.0 amperes was applied. The conversion of ferric ion to ferrous was 40% and the current efficienty was 60%. Hydrogen evolved was estimated to be $3.5\times10^{-3}$ moles per liter of feed.

EXAMPLE 4

The experiment of Example 3 is repeated in all essential details except that carbon felt was substituted for the roughened graphite. A high conversion of ferric to ferrous ion is obtained at high current efficiency and insignificant hydrogen production.

EXAMPLE 5

The experiment of Example 3 is repeated in all essential details except that carbon mat was substituted for the roughened graphite. A high conversion of ferric to ferrous ion is obtained at high current efficiency and insignificant hydrogen production.

EXAMPLE 6

The experiment of Example 3 is repeated in all essential details except that porous flow-through carbon was substituted for the roughened graphite. A high conversion of ferric to ferrous ion is obtained at high current efficiency and insignificant hydrogen production.

We claim:

1. A process for stripping hexavalent uranium from an organic solution containing it by contacting it with a stripping agent which is provided by phosphoric acid containing sufficient ferrous ion to reduce the uranium to the tetravalent state whereupon it passes into the stripping agent, subsequently oxidizing the tetravalent uranium again to the hexavalent state, extracting it with an organic solution, and recovering the uranium therefrom, comprising the step of passing the stripping agent containing ferric ions through the cathode chamber of an electrolytic cell having a cathode chamber and an anode chamber separated by a permeable membrane wherein the cathode is provided by a porous flow-through carbon electrode of high surface area that substantially excludes significant hydrogen production while applying a current density of 5–30 A/dm$^2$ to the cathode at a working potential between approximately 0 mV and −1400 mV versus a saturated calomel electrode thereby reducing ferric ion to ferrous state in the cathode chamber.

2. The process of claim 1 wherein the cathode is made of reticulated vitreous carbon.

3. The process of claim 1 wherein the cathode is made of carbon felt.

4. The process of claim 1 wherein the cathode is made of carbon mat.

5. The process of claim 1 wherein the current density is from 5 to 20 amperes per square decimeter.

6. The process of claim 1 wherein the current density is from 5 to 25 amperes per square decimeter.

7. A process for stripping hexavalent uranium from an organic solution containing it by contacting it with a stripping agent which is provided by phosphoric acid containing sufficient ferrous ion to reduce the uranium to the tetravalent state whereupon it passes into the stripping agent, subsequently oxidizing the tetravalent uranium again to the hexavalent state, extracting it with an organic solution, and recovering the uranium therefrom, comprising the step of passing the stripping agent containing ferric ions through the cathode chamber of an electrolytic cell having a cathode chamber and an anode chamber separated by a permeable membrane wherein the cathode is provided by a roughened graphite carbon electrode of high surface area that substantially excludes significant hydrogen production while applying a current density of 5–30 A/dm$^2$ to the cathode at a working potential between approximately 0 mV and −1400 mV versus a saturated calomel electrode thereby reducing ferric ion to the ferrous state in the cathode chamber.

* * * * *